US009101009B2

(12) United States Patent
Osterried

(10) Patent No.: US 9,101,009 B2
(45) Date of Patent: Aug. 4, 2015

(54) CIRCUIT ARRANGEMENT FOR OPERATING N PARALLEL-CONNECTED STRINGS HAVING AT LEAST ONE SEMICONDUCTOR LIGHT SOURCE

(71) Applicant: OSRAM GmbH, Munich (DE)

(72) Inventor: Josef Osterried, Ottobrunn (DE)

(73) Assignee: Osram GmbH, Munich (DE)

( * ) Notice: Subject to any disclaimer, the term of this patent is extended or adjusted under 35 U.S.C. 154(b) by 0 days.

(21) Appl. No.: 14/097,275

(22) Filed: Dec. 5, 2013

(65) Prior Publication Data

US 2014/0177664 A1 Jun. 26, 2014

(30) Foreign Application Priority Data

Dec. 21, 2012 (DE) ..... 10 2012 224 346

(51) Int. Cl.
*H05B 37/02* (2006.01)
*H05B 33/08* (2006.01)

(52) U.S. Cl.
CPC ..... *H05B 33/0806* (2013.01); *H05B 33/086* (2013.01); *H05B 33/0815* (2013.01); *H05B 33/0827* (2013.01)

(58) Field of Classification Search
USPC ..... 315/191, 192, 210, 217, 291, 297, 312
See application file for complete search history.

(56) References Cited

U.S. PATENT DOCUMENTS 8,053,923 B2 11/2011 Tateishi et al.
2006/0255753 A1* 11/2006 Sawada et al. ..... 315/312
2009/0066262 A1* 3/2009 Tateishi et al. ..... 315/291
2011/0285685 A1* 11/2011 Naito et al. ..... 345/211
2013/0162152 A1* 6/2013 Lee et al. ..... 315/192

FOREIGN PATENT DOCUMENTS

DE 112006002875 T5 11/2008
WO 2012140634 A1 10/2012

OTHER PUBLICATIONS

Office action issued in the corresponding German application No. 10 2012 224 346.1, dated Sep. 10, 2013, 5 pages.

MAX16821A/MAX16821B/MAX16821C, High-Power Syncronous HBLED Drivers with Rapid Current Pulsing, Maxim Integrated Products Inc., 2010, pp. 1-24.

* cited by examiner

*Primary Examiner* — Daniel D Chang

(57) ABSTRACT

A circuit arrangement may include an input for coupling to a supply voltage; n semiconductor light source units comprising a driver device; wherein the units are coupled in parallel, wherein each driver device comprises a PWM controller. A respective controller is designed to provide a PWM signal at a respectively predefinable frequency to a control electrode of a respective converter switch. The arrangement includes current measuring devices which are designed for measuring the current through a respective string having at least one semiconductor light source; and a control device having control outputs, wherein each controller has a clock input, wherein a respective control output is coupled to a respective clock input of the controllers, wherein the control device is designed to provide clock signals at its control outputs, said clock signals being phase-shifted by 360°/n with respect to one another.

12 Claims, 3 Drawing Sheets

CIRCUIT ARRANGEMENT FOR OPERATING N PARALLEL-CONNECTED STRINGS HAVING AT LEAST ONE SEMICONDUCTOR LIGHT SOURCE

CROSS-REFERENCE TO RELATED APPLICATION

This application claims priority to German Patent Application Serial No. 10 2012 224 346.1, which was filed Dec. 21, 2012, and is incorporated herein by reference in its entirety.

TECHNICAL FIELD

Various embodiments relate generally to a circuit arrangement for operating n parallel-connected strings having at least one semiconductor light source, where n is greater than or equal to 2, including an input having a first and a second input terminal for coupling to a DC supply voltage, n semiconductor light source units including in each case a driver device and an output for coupling to at least one string having at least one semiconductor light source, wherein said n semiconductor light source units are coupled in parallel between the first and the second input terminal, wherein each driver device includes a PWM (pulse width modulation) controller having a drive output and also a converter, wherein each converter includes at least one inverter inductance, a converter diode and a converter switch having a control electrode, a working electrode and a reference electrode, wherein the drive output of the respective PWM controller is coupled to the control electrode of the respective converter switch, wherein the output of the respective converter is coupled to the output of the respective semiconductor light source unit, wherein the respective PWM controller is designed to provide a PWM signal at a respectively predefinable frequency to the control electrode of the respective converter switch, and n current measuring devices which are designed and arranged for measuring the current through a respective one of the n strings having at least one semiconductor light source, wherein each current measuring device is coupled to the respectively associated driver device.

BACKGROUND

In the explanations below, the term semiconductor light sources should be understood to mean, in particular, laser diodes and light emitting diodes (LEDs). A generic circuit arrangement is known from the prior art and is used for example for operating laser diodes in video projectors. A current-regulated step-up converter is used for setting the current provided to the laser diodes. Usually, 24 to 40 individual laser diodes are connected in series in three to five strings each having six to eight laser diodes. Each string is fed by a dedicated driver, wherein the clock frequency of the respective PWM controllers used in the driver is set by an ohmic resistor coupled to one of the inputs of the PWM controller. Said clock frequency determines the switching frequency of the associated converter switch.

However, a DLP projection system equipped with such a circuit arrangement exhibits undesired, visible fluctuations in the brightness of the projected image.

A laser diode string is usually used for realizing a color channel. A system having, for example, four semiconductor light source units accordingly realizes a four-channel projection system.

SUMMARY

A circuit arrangement may include an input for coupling to a supply voltage; n semiconductor light source units comprising a driver device; wherein the units are coupled in parallel, wherein each driver device comprises a PWM controller. A respective controller is designed to provide a PWM signal at a respectively predefinable frequency to a control electrode of a respective converter switch. The arrangement includes current measuring devices which are designed for measuring the current through a respective string having at least one semiconductor light source; and a control device having control outputs, wherein each controller has a clock input, wherein a respective control output is coupled to a respective clock input of the controllers, wherein the control device is designed to provide clock signals at its control outputs, said clock signals being phase-shifted by 360°/n with respect to one another.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
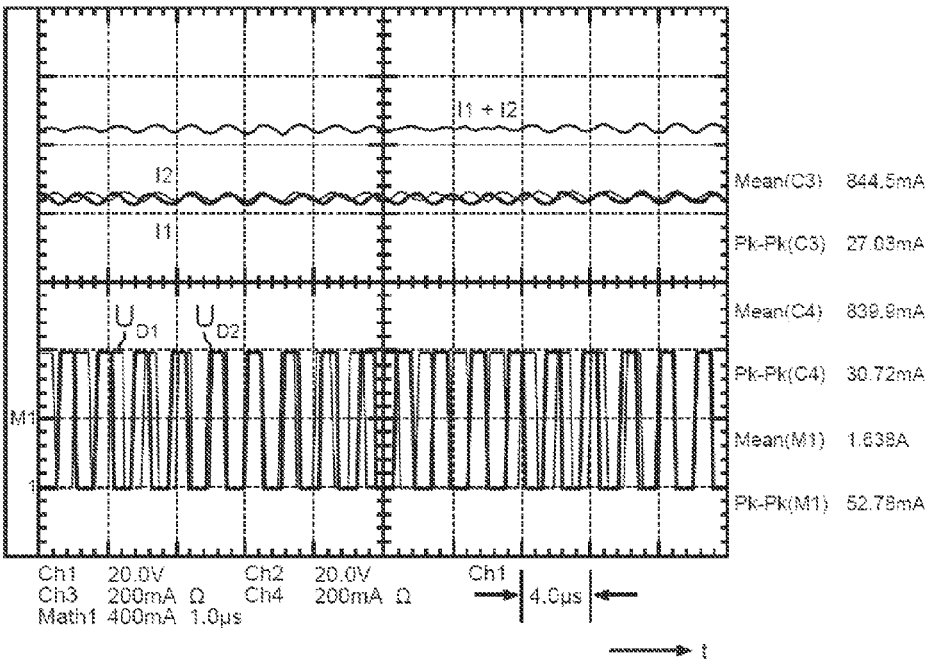
Fig.1 (Prior art)
FIG. 1 shows a schematic illustration of the temporal profile of various variables of a conventional circuit arrangement.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments develop a generic circuit arrangement in such a way that the extent of said visible fluctuations in brightness is reduced, and in various embodiments no fluctuations in brightness whatsoever are discernible any longer.

Various embodiments are based on the insight that the cause of the fluctuations in brightness is that the total luminous flux of all the semiconductor light sources exhibits ripple and contains relatively low-frequency beats caused by different switching frequencies of the converters. Owing to the fact that the clock frequency of the respective PWM controller is set by means of ohmic resistors and the latter having component tolerances, the clock frequencies of the respective PWM controllers and thus the switching frequencies of the respective converter switches deviate slightly from one another. The conventional individual semiconductor light source units as mentioned above are accordingly operated asynchronously. This leads to low-frequency oscillation effects: if, for example, the clock frequency of a first PWM controller is 500 kHz and that of a second PWM controller is 499 kHz, then this results in components in the output signal at the difference frequency F1−F2=1 kHz and at the summation frequency F1+F2=999 kHz. The component at 999 kHz is not relevant with regard to fluctuations in brightness. However, the component at 1 kHz is critical and leads to discernible fluctuations in brightness in the image.

In various embodiments, therefore, the switching frequencies of the individual driver devices are synchronized and an offset of the phases by 360° divided by the number of semiconductor light source units is set.

If, in order to keep the ripple and thus the beats small, a large capacitor block were connected in parallel with each string having at least one semiconductor light source, then although this would reduce the fluctuations in brightness by a specific magnitude, as a result the dynamic range deteriorates in the case of desired-value changes, that is to say in the case of changes in the desired luminous flux to be emitted by the respective channel. Moreover, the use of capacitor blocks leads to a considerable outlay in respect of costs and to an increase in the necessary amount of space required for the circuit arrangement, which is undesirable particularly for mobile applications. Nevertheless, in a circuit arrangement according to the invention, too, a capacitor can be connected in parallel with the respective string having at least one semiconductor light source, but said capacitor can turn out to be orders of magnitude smaller in view of the now virtually absent ripple of the total luminous flux. According to experience, the smoothing outlay be can reduced by at least a factor of 10 in the case of a circuit arrangement according to the invention. This results in a significant cost saving and a dynamic range not achieved hitherto in the event of desired-value changes.

Therefore, a circuit arrangement according to various embodiments furthermore includes a control device having n control outputs, wherein each pulse width modulation (PWM) controller has a clock input, wherein a respective control output is coupled to a respective clock input of the n PWM controllers, wherein the control device is designed to provide n clock signals at its n control outputs, said clock signals being phase-shifted by 360°/n with respect to one another.

This results in a synchronization in terms of frequency and phase, which leads to low-frequency beats being prevented. All that remains is a small inherent residual ripple at the output of the respective converter, which either no longer leads to any disturbing fluctuations in brightness or can be eliminated with extremely little outlay by means of small capacitors connected in parallel with the strings having at least one semiconductor light source.

The converter may include a step-up converter or a step-down converter, depending on the level of the DC supply voltage provided at the input.

In various embodiments, the respective PWM controller is designed to provide, in response to a clock signal at its clock input, a corresponding output signal, e.g. a rising or a failing edge, or an edge delayed by a predefinable time duration, of a PWM signal, to the control electrode of the respective converter switch, wherein the duty cycle of the PWM signal is determined by the current measured by the respective current measuring device. The phase and/or frequency synchronization is not impaired by this regulation, wherein the current of the respective string having at least one semiconductor light source can nevertheless be regulated to an instantaneous desired value.

In various embodiments, a switch is arranged in series with each output, such that the current through the respective string having at least one semiconductor light source can be switched on and off. In this way, the present circuit arrangement can be used in a particularly simple manner during the operation of an LARP (Laser Activated Remote Phosphor) projection system. This is because the latter may include a color wheel, wherein the individual sections of the color wheel are coated with different phosphors, such that the emission of light with different wavelengths is made possible upon excitation by one and the same laser source. In order to avoid an unnecessary energy consumption and thus costly cooling measures, an electronic switch is coupled in series with each output and makes it possible to prevent the emission of laser radiation at the points in time at which the luminous wheel is not yet in the envisaged position.

The control device may constitute a clock generator, e.g. realized as a microcontroller. However, it may also constitute e.g. an oscillator with downstream phase shifter.

In various embodiments, the control device is integrated in one of the driver devices, e.g. in the PWM controller of the driver device, such that said one driver device constitutes a master and the other driver devices constitute slaves. This makes it possible to construct a circuit arrangement according to various embodiments in a particularly cost-effective manner.

As already mentioned, at least one capacitor can be connected in parallel with each string having at least one semiconductor light source, said at least one capacitor serving for smoothing any residual ripple possibly present.

Further advantageous configurations can be found in the dependent claims.

In the following explanations, the invention is presented on the basis of the example of a circuit arrangement including only two semiconductor light source units, for the sake of simplicity. As is obvious to a person skilled in the art, the embodiments can be extended to any desired number of semiconductor light source units, thus e.g. to n equals 3, 4, 5, 6, etc.

FIG. 1 shows a schematic illustration of the temporal profile of various variables of a conventional circuit arrangement. I1 and I2 designate the currents provided by the respective driver device to the respective strings having at least one semiconductor light source. $U_{D1}$ and $U_{D2}$ designate the voltage at the working electrode of the respective converter switch of the respective semiconductor light source unit relative to reference potential and thus reflect the temporal profile of the respective switching frequencies. As can clearly be discerned, said switching frequencies are asynchronous, such that the currents I1 and I2, each having a certain ripple, also have an asynchronous profile. In the summation current I1+I2 this leads to low-frequency beats and thus to the continuance of a residual ripple, which can lead to fluctuations in brightness in a projected image.

Figure 2:
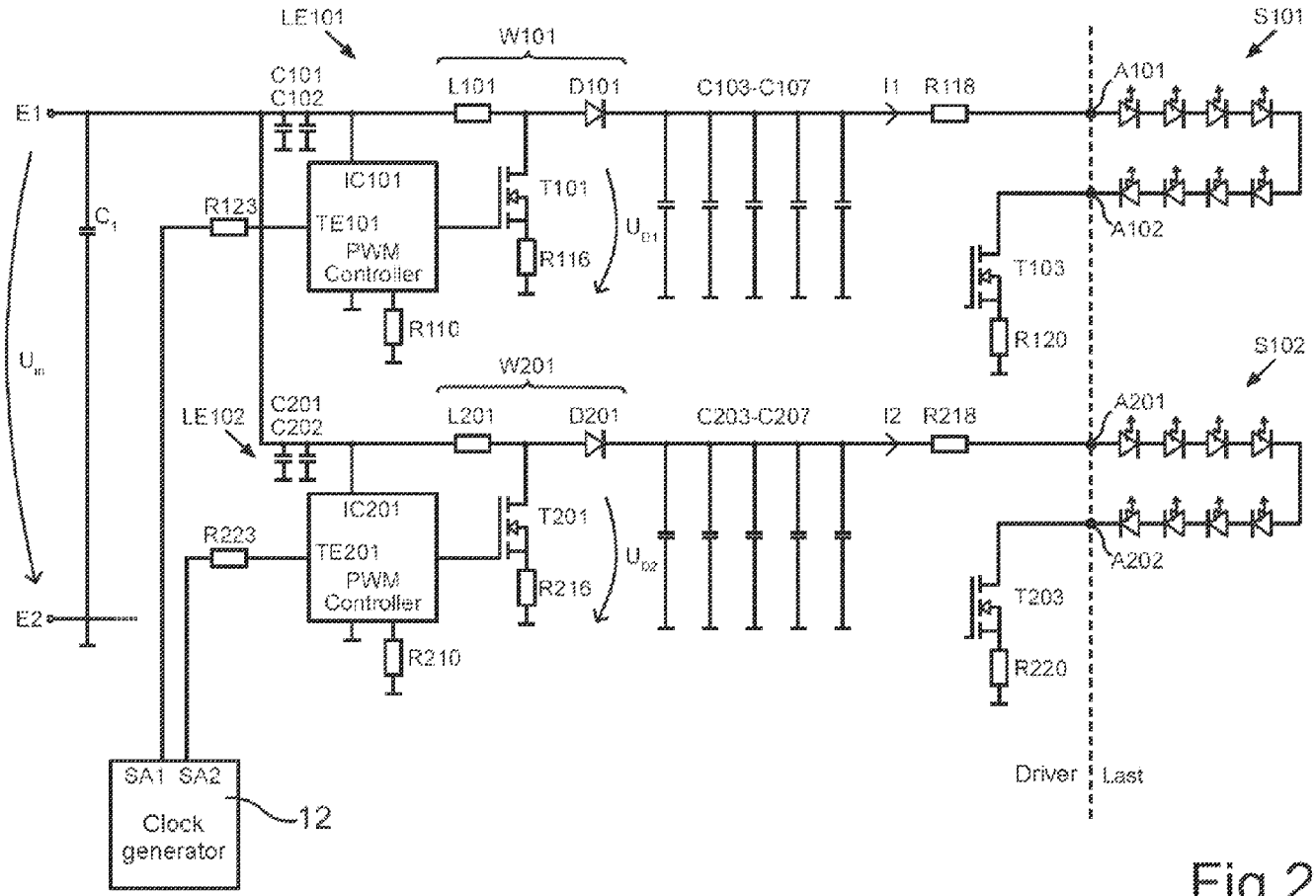
FIG. 2 shows a schematic illustration of the construction of a circuit arrangement in accordance with various embodiments.

FIG. 2 shows a schematic illustration of the construction of a circuit arrangement according to various embodiments. This circuit arrangement includes an input having a first and a second input terminal E1, E2, between which a capacitor C1 is coupled for stabilization purposes. The input voltage $U_{in}$ constitutes a DC supply voltage which can have a value of 12 V, for example. A first semiconductor light source unit LE101 and a second semiconductor light source unit LE102 are coupled in parallel with the input. Each semiconductor light source unit has a driver device and also an output, to which a string having at least one semiconductor light source, in the present case at least one laser diode, can be coupled.

Referring to the first semiconductor light source unit LE101, a PWM controller IC101 is provided, which can be of the AT90PWM316 type, for example. Said PWM controller is coupled by its supply terminal to the input terminal E1. An ohmic resistor R110 is depicted in a dashed manner, which ohmic resistor is coupled to a further input of the IC101 and in the prior art was used for setting the switching frequency of the PWM controller. Alternatively, depending on the PWM controller used, a capacitor may also be required for setting the switching frequency of the PWM controller. In the case of a circuit arrangement according to various embodiments, said resistor R110 serves for setting the switching frequency upon the start-up of the circuit arrangement or upon the failure of the control device 12, yet to be described.

Two capacitors C101 and C102 are coupled to the supply terminal and serve for stabilizing the supply voltage provided to the PWM controller. The semiconductor light source unit LE101 includes a converter W101, which in the present case is embodied as a step-up converter and includes a converter inductance L101, a converter diode D101 and a converter switch T101. An ohmic resistor R116 is coupled in series with the converter switch T101 and serves for measuring the current through the converter inductance L101. This is necessary in order to ensure that the inductance L101 does not attain saturation. In the present case, the converter switch T101 is embodied as a metal oxide semiconductor field effect transistor (MOSFET), wherein the voltage dropped at its drain terminal is designated by $U_{D1}$. The output voltage of the converter D101 is smoothed by means of five capacitors C103 to C107 connected in parallel. The output current I1 flows to the output terminal A101, said output current also flowing beforehand through a shunt resistor R118, which serves to measure the output current I1. A string having at least one semiconductor light source S101 is arranged between the output terminal A101 and a second output terminal A102 and may include a plurality of semiconductor light sources coupled in series. A transistor T103 is arranged between the output terminal A102 and a reference potential and serves for switching the string S101 having at least one semiconductor light source on and off in response to a corresponding drive signal (not illustrated). An ohmic resistor R120 is arranged in series with the switch T103, wherein the voltage dropped across the ohmic resistor R120 can be used for further regulation tasks.

The semiconductor light source unit LE102 is embodied in a manner corresponding to the semiconductor light source unit LE101, wherein the input transistors bear the designations C201, C202, the PWM controller bears the designation IC201, the converter bears the designation W201, wherein the converter includes a converter inductance L201, a converter diode D201 and a converter switch T201. The ohmic resistor arranged in series with the converter switch T201 is designated by R216 and the voltage dropped at the working electrode of the converter switch T201 is designated by $U_{D2}$. The smoothing capacitors bear the designations C203 to C207. The output current is designated by I2 and the shunt resistor used for regulating the output current is designated by R218. The ohmic resistor conventionally used for setting the switching frequency of the PWM controller is designated by R210. The output of the semiconductor light source unit LE102 includes output terminals A201 and A202, wherein a string S102 having at least one semiconductor light source is coupled between said output terminals. The switch for switching the string S102 having at least one semiconductor light source on and off is designated by T203, wherein a resistor R220 is arranged in series with the switch T203.

In various embodiments, a control device 12 is provided, which includes a first and a second control output SA1, SA2, which are connected to respective clock inputs TE101 and TE201 of the PWM controllers IC101 and IC201 via ohmic resistors R123 and R223, respectively. The control device 12 is designed to provide at the control outputs SA1, SA2 clock signals which are phase-shifted by 180° with respect to one another. The respective PWM controller IC101, IC201 is designed to provide, in response to a clock signal at its clock input TE101 and TE201, respectively, a rising or falling edge or a temporally delayed edge of a PWM signal to the control electrode of the respective converter switch T101, T201, wherein the duty cycle of the PWM signal is determined with the aid of the current R118 and R218 in accordance with a current I1 and I2, respectively. If a plurality of semiconductor light source units are intended to be operated, then a plurality of control outputs should be provided, wherein the control device 12 is then designed to provide at its n control outputs n clock signals that are phase-shifted by 360°/n with respect to one another.

The control device 12 may be realized as a clock generator, e.g. embodied as a microcontroller. However, it may also constitute an oscillator with a downstream phase shifter. In various embodiments, the control device 12 is integrated in one of the driver devices IC101 or IC201, such that one driver device, for example IC101, constitutes a master and the other remaining n−1 driver devices, for example IC201, constitute slaves.

Figure 3:
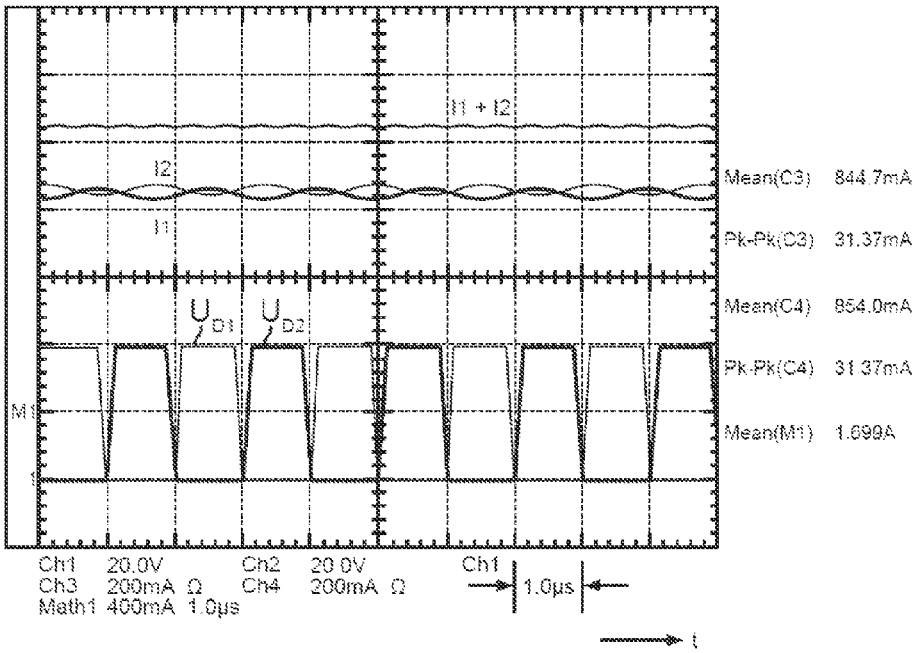
FIG. 3 shows a schematic illustration of the temporal profile of various variables of a circuit arrangement in accordance with various embodiments.

FIG. 3 shows the temporal profiles—corresponding to FIG. 1—of the drain voltages $U_{D1}$, $U_{D2}$, of the output currents I1, I2 and of the summation current I1+I2 for a circuit arrangement according to various embodiments. For the sake of better resolution, however, the time axis has been magnified by a factor of four. As can clearly be discerned on the basis of the temporal profile of the drain voltages $U_{D1}$, $U_{D2}$, the latter are now phase-shifted by exactly 180°. This results in the currents I1, I2 likewise being synchronized, such that the summation current I1+I2 virtually no longer has any residual ripple. With such a summation current I1+I2, in the case of a projection system including a corresponding circuit arrangement according to various embodiments, fluctuations in brightness are no longer discernible at all.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A circuit arrangement for operating n parallel-connected strings having at least one semiconductor light source, where n is greater than or equal to 2, the circuit arrangement comprising:

an input having a first input terminal and a second input terminal for coupling to a DC supply voltage;

n semiconductor light source units comprising in each case a driver device and an output for coupling to at least one string having at least one semiconductor light source;

wherein the n semiconductor light source units are coupled in parallel between the first input terminal and the second input terminal, wherein each driver device comprises a PWM controller having a drive output and also a converter, wherein each converter comprises at least one inverter inductance, a converter diode and a converter switch having a control electrode, a working electrode and a reference electrode, wherein the drive output of the respective PWM controller is coupled to the control electrode of the respective converter switch, wherein the output of the respective converter is coupled to the output of the respective semiconductor light source unit, wherein the respective PWM controller is designed to provide a PWM signal at a respectively predefinable frequency to the control electrode of the respective converter switch; and n current measuring devices which are designed and arranged for measuring the current through a respective one of the n strings having at least one semiconductor light source, wherein each current measuring device is coupled to the respectively associated driver device; and a control device having n control outputs, wherein each PWM controller has a clock input, wherein a respective control output is coupled to a respective clock input of the n PWM controllers, wherein the control device is designed to provide n clock signals at its n control outputs, said clock signals being phase-shifted by 360°/n with respect to one another.

2. The circuit arrangement of claim 1, wherein the converter comprises a step-up converter or a step-down converter.

3. The circuit arrangement of claim 2, wherein the respective PWM controller is designed to provide, in response to a clock signal at its clock input, a corresponding output signal to the control electrode of the respective converter switch, wherein the duty cycle of the PWM signal is determined by the current measured by the respective current measuring device.

4. The circuit arrangement of claim 3, wherein the respective PWM controller is designed to provide, in response to a clock signal at its clock input, a corresponding output signal as a rising or a falling edge, or an edge delayed by a predefinable time duration, of a PWM signal, to the control electrode of the respective converter switch, wherein the duty cycle of the PWM signal is determined by the current measured by the respective current measuring device.

5. The circuit arrangement of claim 1, wherein an electronic switch is coupled in series with each output, such that the current through the respective string having at least one semiconductor light source can be switched on and off.

6. The circuit arrangement of claim 1, wherein the control device constitutes a clock generator.

7. The circuit arrangement of claim 6, wherein the clock generator is realized as a microcontroller.

8. The circuit arrangement of claim 1, wherein the control device constitutes an oscillator with downstream phase shifter.

9. The circuit arrangement of claim 1, wherein the control device is integrated in one of the driver devices, such that said one driver device constitutes a master and the other driver devices constitute slaves.

10. The circuit arrangement of claim 9, wherein the control device is integrated in the PWM controller of the driver device.

11. The circuit arrangement of claim 1, wherein at least one capacitor is connected in parallel with each string having at least one semiconductor light source.

12. The circuit arrangement of claim 1, wherein the semiconductor light source constitutes an light emitting diode or a laser diode.

* * * * *

UNITED STATES PATENT AND TRADEMARK OFFICE

CERTIFICATE OF CORRECTION

PATENT NO. : 9,101,009 B2
APPLICATION NO. : 14/097275
DATED : August 4, 2015
INVENTOR(S) : Josef Osterried It is certified that error appears in the above-identified patent and that said Letters Patent is hereby corrected as shown below:

In the specification,
Column 3, line 63: Please delete the last word of the line: “failing” and write “falling” in place thereof Signed and Sealed this
First Day of March, 2016

Michelle K. Lee

Michelle K. Lee
*Director of the United States Patent and Trademark Office*